US005735295A

United States Patent [19]

Sammon

[11] Patent Number: 5,735,295

[45] Date of Patent: Apr. 7, 1998

[54] HAIR ADORNMENT HAVING HAIR CLIP

[76] Inventor: Sheila A. Sammon, 58 Thomas St., Coram, N.Y. 11727

[21] Appl. No.: 735,797

[22] Filed: Oct. 21, 1996

[51] Int. Cl.[6] ..... A45D 8/08

[52] U.S. Cl. ..... 132/275; 132/280

[58] Field of Search ..... 132/275, 273, 132/276, 280, 284

[56] References Cited

U.S. PATENT DOCUMENTS

| | | | |
|---|---|---|---|
| 2,334,937 | 11/1943 | La Fair | 132/275 |
| 2,466,529 | 4/1949 | Youngs | 132/275 |
| 2,531,024 | 11/1950 | Bolinger | 132/284 |
| 2,660,826 | 12/1953 | Bennett | 132/275 |
| 3,183,915 | 5/1965 | Bolinger | 132/275 |
| 3,540,491 | 11/1970 | Solomon | 132/284 |
| 5,379,783 | 1/1995 | Healzer et al. | 132/275 |
| 5,398,705 | 3/1995 | Hiltbrand et al. | 132/273 |
| 5,441,061 | 8/1995 | Jordan et al. | 132/275 |

*Primary Examiner*—Todd E. Manahan
*Attorney, Agent, or Firm*—Michael I. Kroll

[57] ABSTRACT

A decorative bobby pin for adorning and securing in the hair, and a method of fabricating the same. A decorative component is adhered to the straight arm of a bobby pin. The decorative component preferably comprises a single section of flexible fabric bunched or gathered at periodic intervals and pinned in this configuration. A bead is secured to the fabric at each fastener securing the bunched or gathered fabric. The fabric is preferably slightly longer and considerably wider than the bobby pin.

2 Claims, 1 Drawing Sheet

HAIR ADORNMENT HAVING HAIR CLIP

BACKGROUND OF THE INVENTION

1. Field of the Invention

The present invention relates to a utilitarian ornament for the hair. More specifically, the invention combines an adornment fastened to a holding device for entrapping a lock of hair. The holding device is a hairpin having arms resiliently biased to close against one another. The adornment comprises a section of flexible fabric bunched and pinned for aesthetic effect.

2. Description of the Prior Art

Adornments for the hair are quite old. These devices require two components, an aesthetically appealing or decorative component, and structure for securing the decorative component to the hair. An example is seen in U.S. Pat. No. 3,183,915, issued to George Noel Bolinger on May 18, 1965. Bolinger's device comprises a fabric ribbon secured to a clasp by partial entrapment within a ring formed integrally with the clasp. By contrast, the present invention utilizes a hairpin lacking the hinge of Bolinger's clasp, relying instead upon adhesive attachment of the decorative component. In preferred embodiments, the decorative component has structure far more complicated than that of the ribbon of Bolinger's device.

A hairpin is utilized for attachment in a device illustrated in U.S. Design Pat. No. 199,424, issued to Joan Weiss on Oct. 20, 1964. However, Weiss's device fails to conceal the hairpin along its length, as is accomplished by the present invention. Also, the component attached to the hairpin requires rigid members for encircling and retaining the hairpin. By contrast, the decorative component of the present invention is joined to its hairpin by adhesive.

U.S. Pat. No. 2,357,871, issued to George N. Bolinger on Sep. 12, 1944, shows another device incorporating a hairpin. Bolinger's device is similar to that of Weiss, in that the hairpin is not concealed by the ornament, and attachment of the decorative component is not by adhesive.

U.S. Pat. No. 4,896,685, issued to Gary D. Lawrence on Jan. 30, 1990, discloses adhesive for securing a decoration to an item worn in the hair. However, Lawrence's decoration differs significantly from that of the present invention, and lacks a hairpin.

U.S. Pat. No. 3,540,491, issued to Nathan L. Solomon on Nov. 17, 1970, illustrates a satisfactory hairpin. However, no decoration is associated with the hairpin, nor is adhesive for securing an object to the hairpin.

None of the above inventions and patents, taken either singly or in combination, is seen to describe the instant invention as claimed.

SUMMARY OF THE INVENTION

The present invention provides a uniquely uncomplicated adornment for the hair which attaches to the hair. The novel adornment can also be utilized to secure a lock of hair in place. A hairpin is provided to secure the novel adornment to the hair. The adornment includes a section of flexible fabric which both provides aesthetic appeal and also conceals the hairpin.

While the prior art has suggested ribbons as adequate decorations, the present invention improves upon the aesthetic effect of unfolded fabric decorations by bunching or gathering the fabric at periodic intervals to suggest depth and add variation and intricacy to the unadorned ribbon, and by adding beads.

The beads serve a purpose beyond still additional aesthetic effect. Bunching of the fabric is secured by any suitable fastener, such as stitching, glue, staples, and the like. A bead is located above the fastener, thereby concealing the same.

The net effect is one of almost floral intricacy, while providing certain benefits. The fabric is of one piece construction, as opposed to the several pieces which may be provided by individual petals of a simulated flower. This unitary construction assures that the hairpin beneath remains concealed.

The intricate effect thus obtained rivals floral simulations in some respects, while affording certain advantages which are difficult to achieve with floral simulations. The uncomplicated nature of the decorative component provides one efficiency of cost, while utilizing commonly available hairpins adds a second efficiency of cost. Material and labor requirements are thus limited, thereby resulting in reasonable costs for the effects achieved.

The lowered costs are furthered by the method of fastening the decorative component to the hair pin. A strip of adhesive is placed on one side of the hairpin, and this strip contacts and retains the fabric.

The fabric is slightly greater in length than the hairpin, but significantly wider. This assures covering and overlying the hairpin, but adds the advantage that the hairpin may be readily grasped and maneuvered to a precise location. One side or both of the fabric may be manually lifted, thereby affording finger access to the hairpin. When released, the fabric will slump due to its flexibility, and will drape over the hairpin. Thus a plain hairpin may be incorporated into the most stylish adornment without undue risk of revealing itself and spoiling the aesthetic effect.

Accordingly, it is a principal object of the invention to provide an adornment for the hair in combination with structure for fastening the adorning component to the hair.

It is another object of the invention to utilize commonly available hairpins as the structure for fastening the adorning component to the hair.

It is a further object of the invention to assure that the decorative component completely cover the hairpin.

Still another object of the invention is to provide intricacy and variation to the decorative component.

An additional object of the invention is to join the decorative component to the hairpin by adhesive.

It is again an object of the invention to bunch or gather the fabric of the decorative component, pin or fasten the bunched material in place, and conceal fasteners pinning or fastening the bunched material.

It is an object of the invention to provide improved elements and arrangements thereof in an apparatus for the purposes described which is inexpensive, dependable and fully effective in accomplishing its intended purposes.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

These and other objects of the present invention will become readily apparent upon further review of the following specification and drawings.

DETAILED DESCRIPTION OF THE PREFERRED EMBODIMENTS

Figure 1:
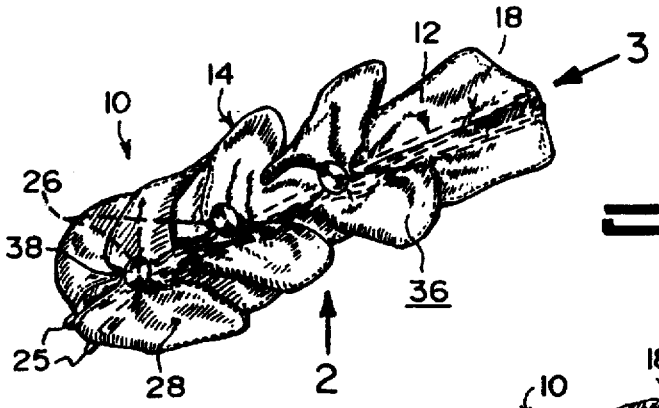
FIG. 1 is a top perspective view of a preferred embodiment of the invention.

Turning now to FIG. 1 of the drawings, novel decorative bobby pin 10 comprises a device 12 for fastening to and engaging the hair of a person (not shown) and a decorative component 14 fastened to and concealed beneath device 12. Device 12 preferably comprises a hairpin 18 having certain structural characteristics which will be discussed further hereinafter. Hairpin 18 has rounded tips 25 visible in FIG. 1.

Figure 4:
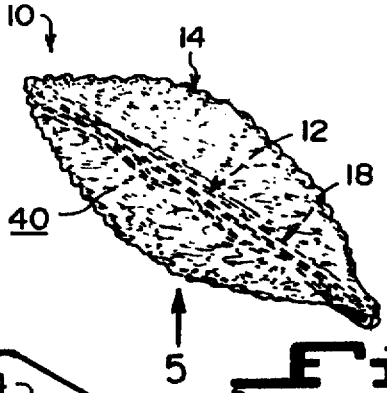
FIG. 4 is a top perspective view of a second embodiment of the invention.

Decorative component 14 is preferably a textile decoration comprising a continuous section of flexible fabric 36. Fabric 36 is bunched or gathered at periodic intervals along the length of hairpin 18, as indicated by 26. Regardless of whether fabric 36 is bunched or is provided in flat, unfurled form, as shown in FIG. 4, it entirely covers and overlies hairpin 18. This characteristic enables fabric 36 to conceal hairpin 18. Thus, only decorative component 14 is visible after installation.

Bunching of fabric 36 at 26 is secured in this configuration by any suitable fastener, such as stitching 28. Obviously, other fasteners (not shown) may be utilized, such as glue, staples, and still others. Beads 38 are mounted on fabric 36 above each stitch 28 (or, of course, above any other fastener). Beads 38 both enhance adornment of decorative component 14 and serve the further function of concealing stitching 28.

Figure 2:
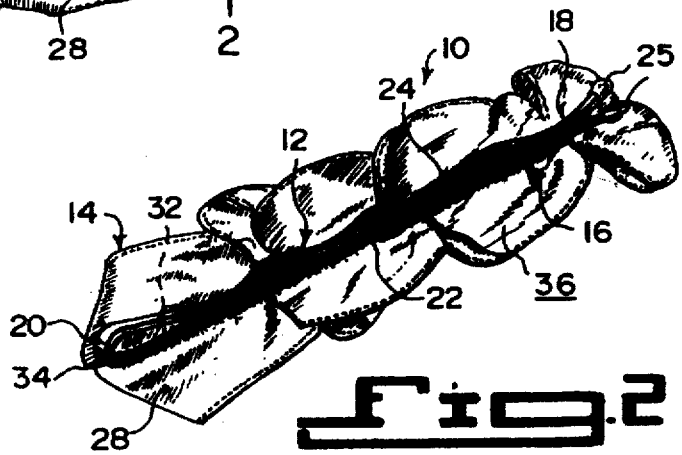
FIG. 2 is a bottom perspective view of the embodiment of FIG. 1.
Figure 3:
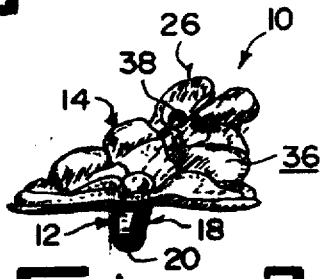
FIG. 3 is an end perspective view of the embodiment of FIG. 1.

FIG. 2 shows hairpin 18 and its attachment to decorative component 14 in greater detail. Hairpin 18 both anchors decorative component 14 to the hair, and also has the ability to perform its usual function of holding a lock of hair (not shown) in place. In its preferred form, hairpin 18 includes a thin strip of metal core material 32 having a synthetic resin coating 34. Hairpin 18 is bent in an elongated U-shaped configuration including a straight arm 22 and an undulating tension arm 24, there being a curved end 20 at the juncture of arms 22 and 24. Arms 22 and 24 each terminate in a rounded tip end 25, which is preferably made from and integral with synthetic resin coating 34. Arms 22 and 24 are resiliently urged towards one another, so that hair can be held securely between straight arm 22 and undulating tension arm 24. Coating 34 imparts a smooth, curved surface to hairpin 18, thereby preventing snagging of hair.

Adhesive material 16 firmly secures decorative component 14 to hairpin 18. Adhesive material 16 is applied to the outer surface of straight arm 22, that being the surface facing decorative component 14, and to the rear surface of fabric 36. Adhesive material 16 is preferably limited to areas of fabric 36 overlying and contacting the outer surface of straight arm 22.

FIGS. 1 and 2 further illustrate preferred dimensional relationships between fabric 36 and hairpin 18. Fabric 36 has a length dimension just greater than that of hairpin 18, so that fabric 36 covers and conceals hairpin 18. Coverage and concealment of hairpin 18 further requires that fabric 36 have a width dimension less than the length of hairpin 18, thus assuring that fabric 36 drape over and conceal said hairpin 18 at lateral sides thereof. A preferred width is less than half the length of fabric 36, so that no portion of fabric 36 be located too far from hairpin 18, and thereby be excessively flaccid. At the same time, flexibility of fabric 36 assures that it can be lifted by the fingers (not shown) to afford finger access to hairpin 18 for maneuvering hairpin 18 in the hair.

Figure 5:
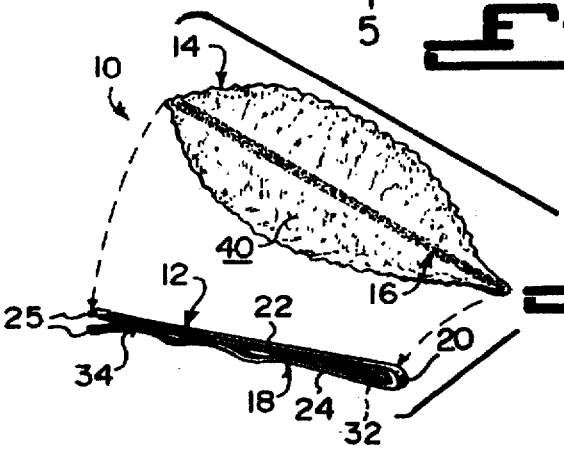
FIG. 5 is an exploded perspective view of the embodiment of FIG. 4.

FIGS. 4 and 5 illustrate another embodiment of the invention lacking bunching and beads. In this embodiment, a leaf shaped fabric 40 is provided and adhered to hairpin 18. The limited area of fabric 40 which overlies and contacts hairpin 18 is clearly seen in FIG. 4. A comparable area (not shown) exists in the embodiment of FIG. 1. It will be appreciated that this limited area treated with adhesive 16 minimizes detrimental saturation of fabric 40 by adhesive.

Decorative bobby pin 10 may be fabricated inexpensively by providing a hairpin 18 and a single, continuous section of flexible fabric 36 having desired aesthetic features and of length just greater than that of the hairpin and width less than the length of fabric 36, and adhering the section of fabric 36 to hairpin 18 in overlying relationship, with fabric 36 draping over right and left sides of hairpin 18.

However, much superior aesthetic effect will be obtained if the method of fabricated is expanded to further include the steps of bunching fabric 36 at periodic intervals as illustrated in FIG. 1, and pinning or fastening fabric 36 in the bunched condition with a fastener, such as stitching 28 at each interval. A finished appearance is assured by fastening one bead 38 above each fastener 28, thereby concealing stitching 28.

It is to be understood that the present invention is not limited to the embodiments described above, but encompasses any and all embodiments within the scope of the following claims.

LIST OF REFERENCE NUMERALS

10 decorative bobby pin
12 device for fastening to hair
14 decorative component
16 adhesive material
18 hairpin
20 curved end of hairpin 18
22 straight arm
24 tension arm
25 rounded tips
26 bunching
28 stitching for bunching 26
32 metal core material
34 synthetic resin coating
36 flexible fabric
38 bead
40 leaf shaped fabric

I claim:

1. A decorative bobby pin for securement to and adornment of hair, comprising:

a straight hairpin for holding a lock of hair in place, said hair pin including a thin strip of metal core material coated with a synthetic resin and bent in an elongated U-shaped configuration including a straight arm, and undulating tension arm, and a pair of rounded tip ends made from and integral with said synthetic resin, so that hair can be held between said straight arm and said undulating tension arm;

adorning means for the hair, including a textile decoration comprising a one piece continuous section of flexible fabric entirely covering and overlaying said hairpin said section of flexible fabric being bunched at periodic intervals along the length of said hairpin and secured in this configuration by fastening means disposed at periodic intervals in a line along the length of said hairpin for attaching said fabric directly to said hairpin, and a bead mounted on said flexible fabric above each said fastening means, said beads being spaced in a straight row along the length of said hairpin, whereby adornment of said adornment means is enhanced and said fastening means are concealed by said beads, said section of flexible fabric having a length dimension just greater than that of said hairpin, whereby said section of flexible fabric covers and conceals said hairpin, and a width dimension less than half the length of said hairpin, whereby said section of flexible fabric drapes over said hairpin and conceals said hairpin at lateral sides thereof, and can be lifted by the fingers to afford finger access to said hairpin for maneuvering said hairpin; and said fastening means comprising adhesive material applied to said outer surface of said straight arm of said hairpin and to said rear surface of said flexible fabric only at overlying areas of said flexible fabric.

2. A method of fabricating a decorative bobby pin, comprising the steps of:

a) providing a straight hairpin;

b) providing a single, continuous section of flexible fabric of length just greater than that of the hairpin and width less than half the length of the section of flexible fabric;

c) adhering the section of flexible fabric directly to the hairpin at locations in spaced intervals along the length of said hairpin in overlying relationship, with the fabric draping over right and left sides of the hairpin; and d) fastening a bead over each of said locations on said fabric to conceal said locations forming a row of spaced beads in a straight line along the length of said hairpin.

* * * * *